US009856044B2

(12) United States Patent
Frazier et al.

(10) Patent No.: US 9,856,044 B2
(45) Date of Patent: Jan. 2, 2018

(54) TAPE CLOSURE APPARATUS WITH DIGITAL ENCODER

(71) Applicant: Burford Corp., Maysville, OK (US)

(72) Inventors: Jimmy R. Frazier, Norman, OK (US); Scott Clemons, Blanchard, OK (US); Jerry Pack, Purcell, OK (US)

(73) Assignee: Burford Corporation, Maysville, OK (US)

( * ) Notice: Subject to any disclaimer, the term of this patent is extended or adjusted under 35 U.S.C. 154(b) by 569 days.

(21) Appl. No.: 13/722,030

(22) Filed: Dec. 20, 2012

(65) Prior Publication Data

US 2013/0152507 A1 Jun. 20, 2013

Related U.S. Application Data

(60) Provisional application No. 61/578,015, filed on Dec. 20, 2011.

(51) Int. Cl.

| | |
|---|---|
| ***B65B 51/06*** | (2006.01) |
| ***B65B 57/00*** | (2006.01) |
| ***B65B 57/04*** | (2006.01) |

(52) U.S. Cl.

CPC ..... *B65B 51/065* (2013.01); *B65B 57/00* (2013.01); *B65B 57/04* (2013.01)

(58) Field of Classification Search

CPC ..... B65B 7/02; B65B 51/04; B65B 51/06; B65B 51/065; B65B 51/08; B65B 57/04; B65B 67/06; B65B 51/062; B65B 57/00

(Continued)

(56) References Cited

U.S. PATENT DOCUMENTS

| | | | |
|---|---|---|---|
| 1,196,460 | A | 8/1916 | Jessen |
| 2,840,967 | A | 7/1958 | Platt |

(Continued)

FOREIGN PATENT DOCUMENTS

| | | |
|---|---|---|
| CN | 2108692 | 7/1992 |
| CN | 101112917 | 8/2007 |

(Continued)

OTHER PUBLICATIONS

Chinese Application No. 201280066558.9, Notification of the First Office Action, dated Jun. 2, 2015, China.

(Continued)

*Primary Examiner* — Thanh Truong
*Assistant Examiner* — Thomas Wittenschlaeger
(74) *Attorney, Agent, or Firm* — Crowe & Dunlevy, P.C.

(57) ABSTRACT

A tape closure device for securing the neck of a bag with a tape closure includes an automated control system, a tape feed assembly configured to provide a continuous length of tape and a closure application assembly. The closure application assembly also includes an encoder wheel that outputs to the automated control system a signal representative of the length of tape provided to the closure application assembly from the tape feed assembly during the closure cycle. The tape closure device further includes a motorized cutting member that is connected to the automated control system and configured for selective activation by the automated control system in response to the signal provided by the encoder wheel. The selective activation of the motorized cutting member allows the tape closure device to create a tape closure that based on the length of tape drawn into the closure application assembly.

19 Claims, 8 Drawing Sheets

(58) Field of Classification Search
USPC ..... 53/414, 416, 417, 419, 64, 138.1, 138.6, 53/138.7, 139.1, 284.7, 389.3, 66
See application file for complete search history.

(56) References Cited

U.S. PATENT DOCUMENTS

| | | | | |
|---|---|---|---|---|
| 2,845,760 | A | 8/1958 | Hopkins et al. | |
| 2,867,066 | A | 1/1959 | Platt | |
| 2,867,067 | A | 1/1959 | Platt et al. | |
| 2,882,663 | A | 4/1959 | Leighton | |
| 2,916,863 | A | 12/1959 | Leighton et al. | |
| 3,061,158 | A | 10/1962 | Fint et al. | |
| 3,141,277 | A | 7/1964 | Johnston | |
| 3,173,232 | A | 3/1965 | Mercer | |
| 3,221,468 | A | 12/1965 | Casey | |
| 3,345,919 | A | 10/1967 | Kasting et al. | |
| 3,375,634 | A | 4/1968 | Jarund | |
| 3,789,573 | A | 2/1974 | Crabb | |
| 3,791,037 | A | 2/1974 | Di Ciaccio | |
| 4,038,805 | A | 8/1977 | Holladay et al. | |
| 4,044,450 | A | 8/1977 | Raudys et al. | |
| 4,107,903 | A | 8/1978 | Wickersheim | |
| 4,169,346 | A | 10/1979 | Tange | |
| 4,242,171 | A | 12/1980 | Kauer et al. | |
| 4,341,056 | A | 7/1982 | Leanna et al. | |
| 4,534,149 | A | 8/1985 | Hoyland | |
| 4,537,005 | A | 8/1985 | Hoyland | |
| 4,554,776 | A | 11/1985 | Chikatani | |
| 4,621,479 | A | 11/1986 | Hoyland | |
| 4,660,351 | A | 4/1987 | Saitoh | |
| 4,732,643 | A | 3/1988 | Chikatani | |
| 4,813,207 | A | 3/1989 | Rundle | |
| 4,856,258 | A | 8/1989 | Burford et al. | |
| 4,912,913 | A | 4/1990 | Rundle | |
| 4,947,623 | A * | 8/1990 | Saito et al. | 53/493 |
| 5,046,675 | A * | 9/1991 | Rodriguez | B65H 19/262 242/526.2 |
| 5,173,140 | A | 12/1992 | Vasilakes | |
| 5,279,094 | A | 1/1994 | Odom et al. | |
| 5,417,383 | A * | 5/1995 | Rodriguez | B65H 19/262 242/526.2 |
| 5,551,206 | A * | 9/1996 | Fukuda | 53/75 |
| 5,618,376 | A | 4/1997 | van der Storm | |
| 5,771,664 | A | 6/1998 | Recchia, Jr. | |
| 5,896,726 | A | 4/1999 | Kellaway | |
| 6,033,762 | A | 3/2000 | Decker | |
| 6,112,499 | A | 9/2000 | Lyskawa et al. | |
| 6,886,310 | B1 | 5/2005 | Bois | |
| 7,168,560 | B2 | 1/2007 | Finetti et al. | |
| 7,175,582 | B2 * | 2/2007 | Owen | 493/213 |
| 7,484,342 | B2 * | 2/2009 | Frazier | 53/138.7 |
| 8,365,508 | B2 * | 2/2013 | Kenney | 53/589 |
| 2002/0023407 | A1 * | 2/2002 | Kellaway | B65B 51/065 53/139.1 |
| 2005/0217218 | A1 * | 10/2005 | Asma | 53/594 |
| 2007/0107378 | A1 | 5/2007 | Frazier | |
| 2007/0157555 | A1 * | 7/2007 | Tanner | 53/399 |
| 2008/0172986 | A1 * | 7/2008 | Theurer et al. | 53/284.7 |
| 2009/0113853 | A1 * | 5/2009 | Porter et al. | 53/492 |
| 2009/0301031 | A1 * | 12/2009 | Jacobs et al. | 53/381.2 |
| 2014/0224442 | A1 * | 8/2014 | Kida | 162/139 |

FOREIGN PATENT DOCUMENTS

| | | |
|---|---|---|
| CN | 102152871 | 8/2011 |
| EP | 0751593 | 2/1997 |
| EP | 2226255 | 1/2010 |
| GB | 2360268 | 9/2001 |
| WO | 2007139317 | 12/2007 |

OTHER PUBLICATIONS

Application No. 12859494.2-1708, Extended European Search Report, dated Jun. 26, 2015, Europe.

PCT/US2012/070986, PCT International Search Report, dated Mar. 8, 2012.

* cited by examiner

TAPE CLOSURE APPARATUS WITH DIGITAL ENCODER

RELATED APPLICATIONS

The present application claims the benefit of U.S. Provisional Patent Application Ser. No. 61/578,015, filed Dec. 20, 2011 and entitled, "Tape Closure Apparatus with Digital Encoder," the disclosure of which is herein incorporated by reference.

FIELD OF THE INVENTION

The present invention is generally related to the field of automated bag closure systems.

BACKGROUND OF THE INVENTION

For many years, manufacturers have used plastic bags to package a wide variety of products. In some industries, it is desirable to provide a plastic bag that can be repetitively opened and sealed by the consumer. For example, bread is often enclosed in a plastic bag that is bound with a twist-tie. The twist-tie closure allows the consumer to open and close the bag multiple times, thereby extending the use of the bag for the life of the product.

Although twist-ties are favored for their inexpensive cost, competing closure mechanisms have also been employed. For example, plastic lock-tabs are frequently used to close plastic bags containing perishable bakery items. Lock-tabs are easy to apply and offer the packager a surface upon which information can be printed. While generally acceptable, lock-tabs are relatively expensive. As an alternative, manufacturers have employed tape closure systems in which the neck of the bag is captured by a piece of one-sided tape. Tape closure systems offer the cost benefits of twist-ties and the ability to print information on the closure provided by lock-tabs.

Prior art tape closure systems function by applying a preset amount of tape to the neck of the bag. In these systems, changes in the diameter of the bag neck tend to create variations in the "legs" of the tape that extend from the neck. Variations in the lengths of the tape legs increase the difficulty of printing information on the tape and may present problems during use by the consumer. Accordingly, there is a need for an improved tape closure system that overcomes these deficiencies of the prior art.

SUMMARY OF THE INVENTION

In preferred embodiments, the present invention provides an apparatus and method for providing a tape closure around the neck of a bag. Preferred embodiments include a method for applying a tape closure to the neck of a bag that includes steps of providing a continuous length of tape from a roll of tape to a guide rail of a closure application assembly and providing a continuous length of paper from a roll of paper to the guide rail of the closure application assembly. The method continues by passing the neck of the bag through the closure application assembly to draw into the closure application assembly a length of tape from the roll of tape and measuring with the length of the tape drawn into the closure application assembly as the neck of the bag is passed through the closure application assembly. Next, the method continues by encoding the measured length of the tape drawn into the closure application assembly into a tape closure length signal and the tape closure length signal is processed by a control system. Lastly, the method continues as the control system activates a motorized cutting mechanism to sever the continuous length of tape and the continuous length of paper in response to tape closure length signal.

In another preferred embodiment, the present invention includes a tape closure device for securing the neck of a bag with a tape closure during a closure cycle. The tape closure device includes an automated control system, a tape feed assembly configured to provide a continuous length of tape and a closure application assembly. The closure application assembly is configured to pull the continuous length of tape from the tape feed assembly and form the tape closure around the neck of the bag during the closure cycle. The closure application assembly also includes an encoder wheel that outputs to the automated control system a signal representative of the length of tape provided to the closure application assembly from the tape feed assembly during the closure cycle. The tape closure device further includes a motorized cutting member that is connected to the automated control system and configured for selective activation by the automated control system in response to the signal provided by the encoder wheel. The selective activation of the motorized cutting member allows the tape closure device to create a tape closure that based on the length of tape drawn into the closure application assembly.

DETAILED DESCRIPTION OF PRESENTLY PREFERRED EMBODIMENTS

In accordance with a preferred embodiment, the present invention includes a tape closure system for use in conjunction with an automated packaging system. Although the preferred embodiment is disclosed for use in a bakery environment, it will be understood that the tape closure device could find utility in a wide variety of other applications.

Figure 1:
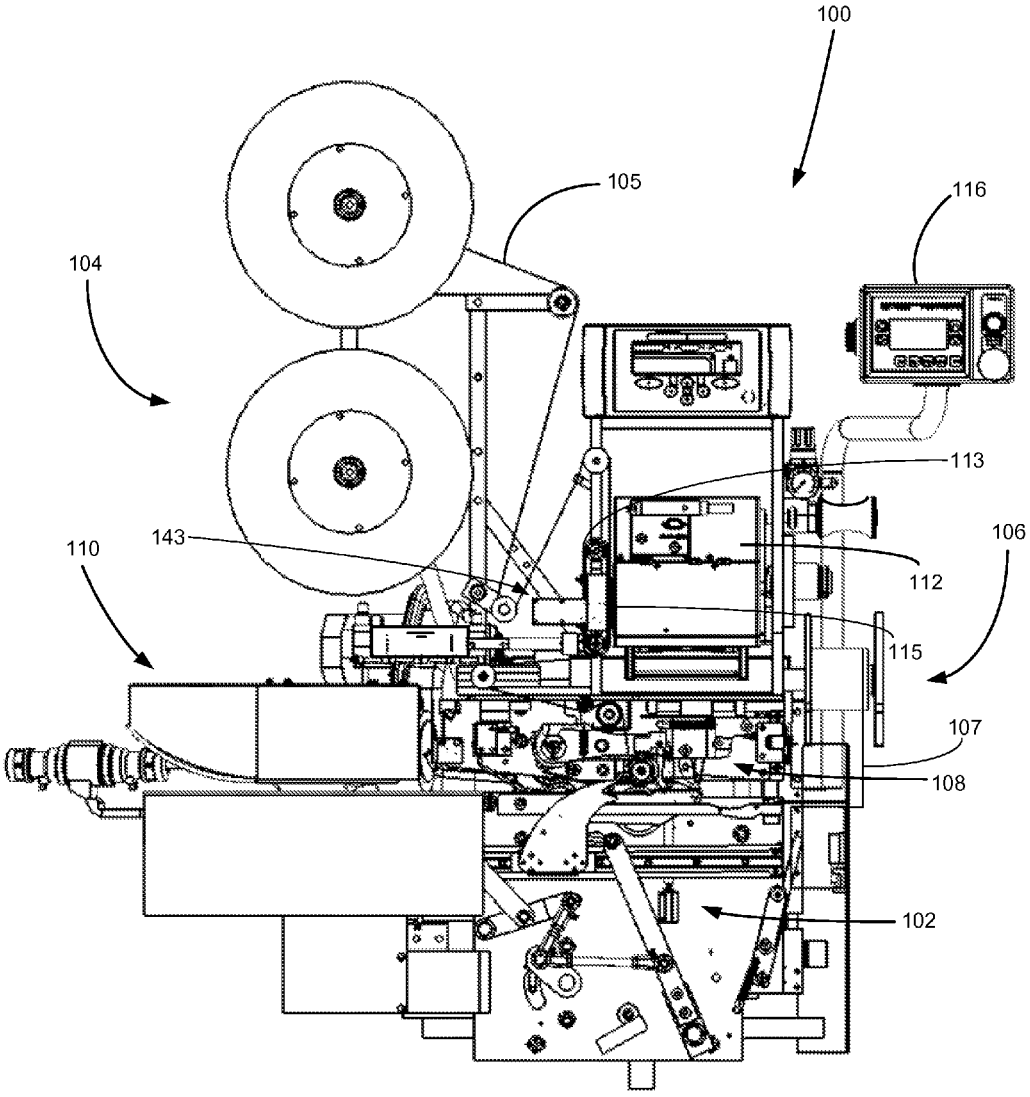
FIG. 1 is a front view of a tape closure device constructed in accordance with a presently preferred embodiment.

Referring to FIG. 1, shown therein is a front view drawing of a preferred embodiment of a tape closure device 100. The tape closure device 100 preferably includes a plunger assembly 102, a tape feed assembly 104, a paper feed assembly 106, a closure application assembly 108 and a bag feed assembly 110. The tape feed assembly 104 is generally configured to provide tape 105 to the closure application assembly 108. The paper feed assembly 106 is generally configured to provide paper 107 to the closure application assembly 108.

The tape closure device 100 also preferably includes a printer assembly 112 and a control system 116. The printer assembly 112 is configured to print desired information (e.g., date, location, batch) on the tape 105 delivered from the tape feed assembly 104. The printer assembly 112 includes a print belt 113 that places the tape 105 into contact with a print head 115. The control system 116 is used to control and adjust the automated function of the tape closure device 100. Although the control system 116 is depicted in FIG. 1 in the user control module, it will be appreciated that the control system 116 can be located or distributed throughout the tape closure device 100.

The tape closure device 100 is preferably placed in adjacency with a conveyor system and is well adapted to be used in concert with a conveyor-type, assembly line packaging operation. The conveyor system and tape closure device 100 may be configured to carry filled bags from right to left through the tape closure device 100, or left to right through the tape closure device 100 as depicted in FIG. 1. It will be understood that through use of the control system 116, the operation of the tape closure device 100 is automated and configurable based on user settings and closed-loop feedback.

Figure 2:
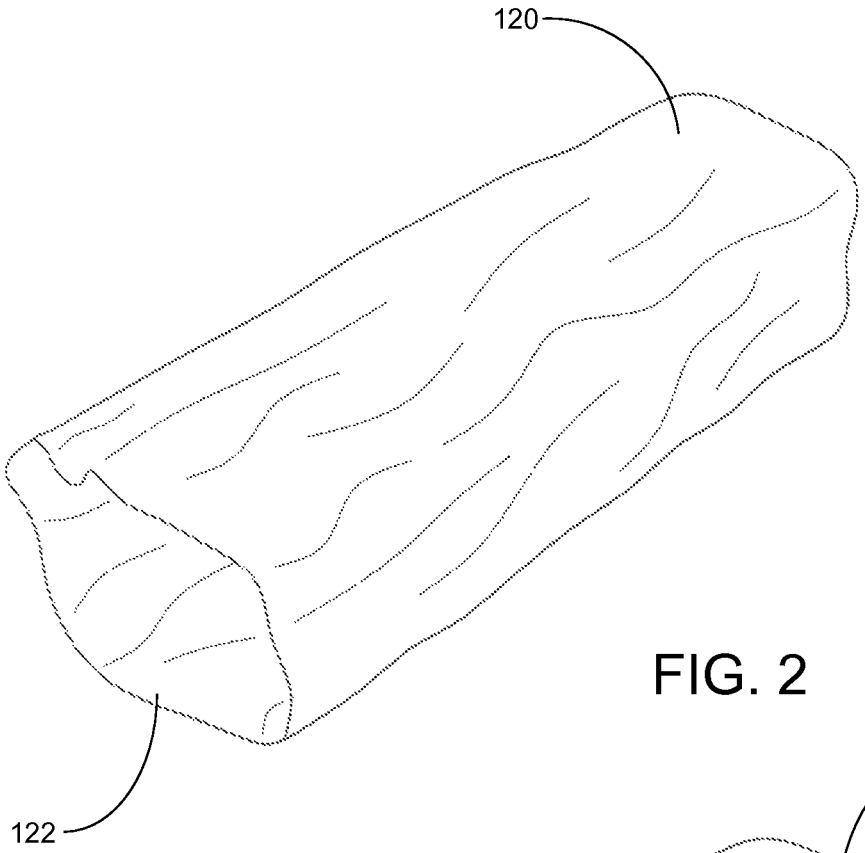
FIG. 2 is a perspective view of a bag with an open end.
Figure 3:
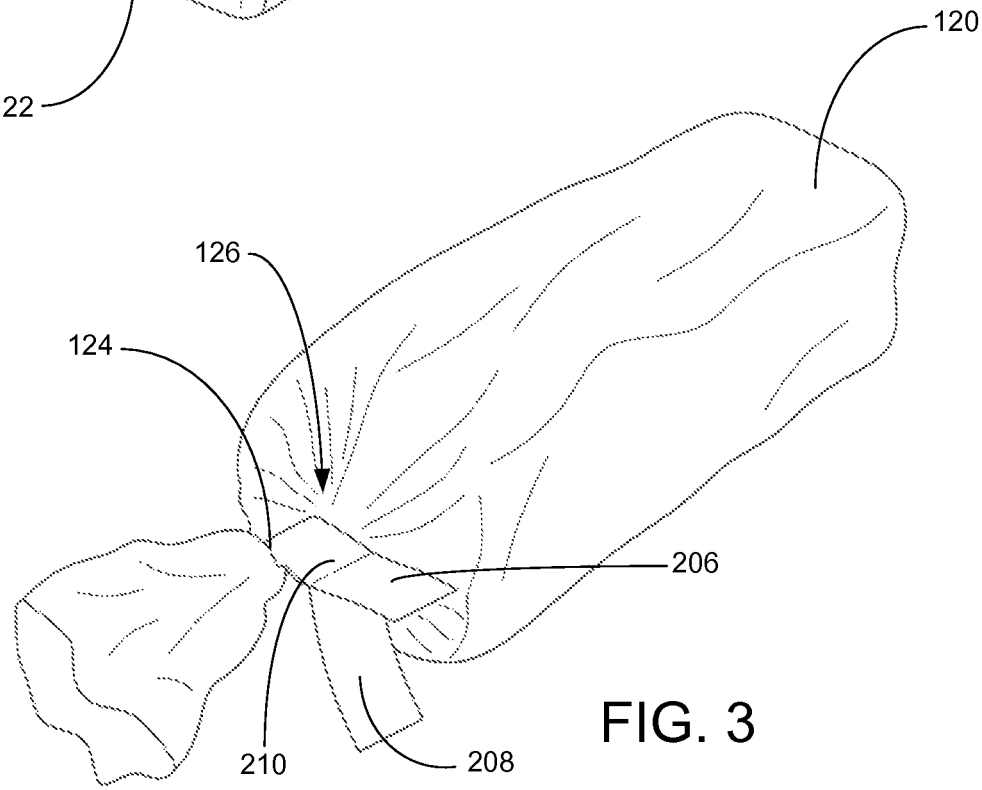
FIG. 3 is a perspective view of a bag with a closure around the neck.

Referring now also to FIGS. 2 and 3, starting on the upstream side of the conveyor system, unclosed bags 120 are fed through the bag feed assembly 110 with an open end 122 of the bag 120 passing through the closure application assembly 108. As the bags 120 pass through the tape closure device 100, the tape closure device 100 gathers the open ends of each bag 120 into a neck 124 and applies a tape closure 126 around the neck 124 to keep the bag 120 closed. The tape closure 126 preferably includes a first leg 206, a second leg 208 and a tape loop 210 around the neck 124 of the bag 120. Each of the first and second legs 206, 208 is preferably formed with the tape 105 being partially secured to the backing paper 107. The tape loop 210 is preferably adhered directly to the neck 124 of the bag 120. The tape 105 is preferably one-sided releasable adhesive tape and the paper 107 is preferably a non-adhesive backing paper that facilitates release of the closure 126. The tape closure 126 is configured to be repetitively removed and re-attached to the neck 124 of the bag 120. FIGS. 2 and 3 provide perspective views of the bag 120 with the open end 122 and the bag 120 with the closure 126 around the neck 124, respectively.

Figure 4:
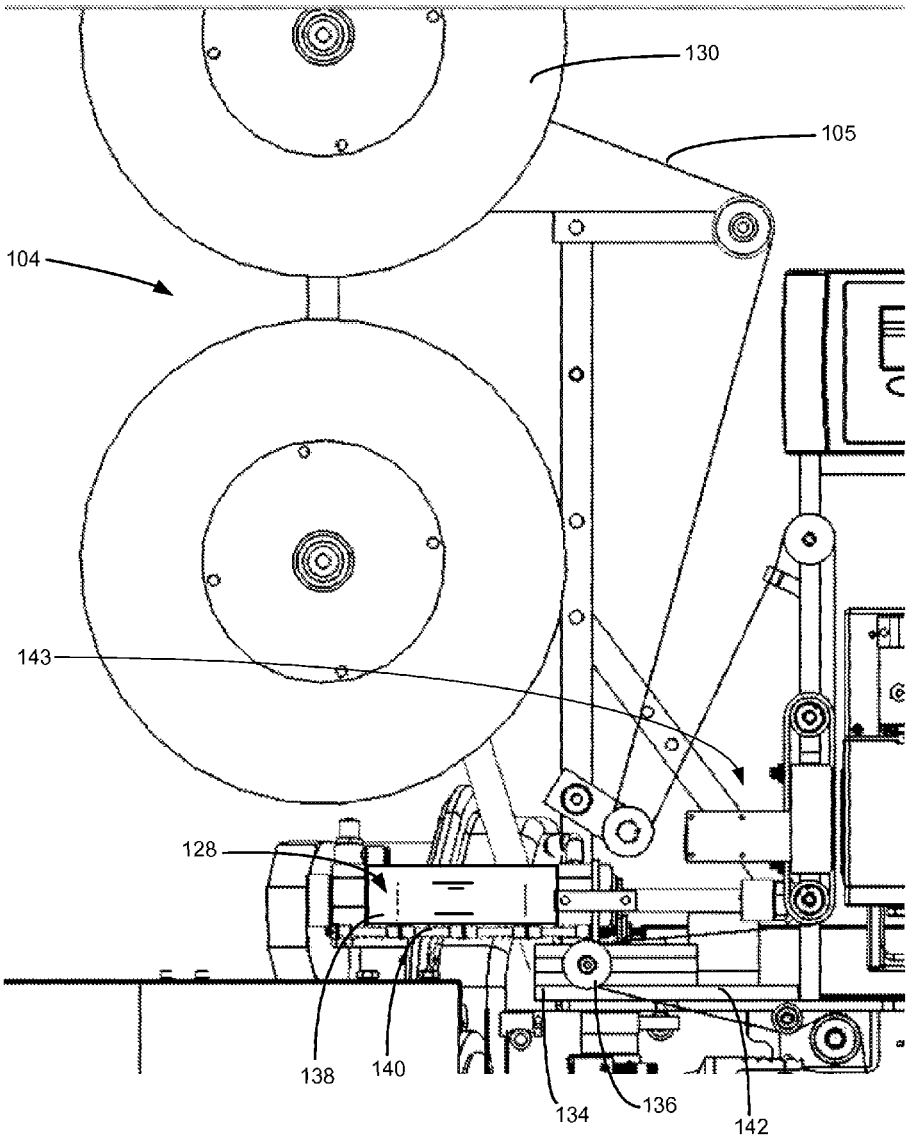
FIG. 4 is a close-up view of a portion of the tape feed assembly.
Figure 5:
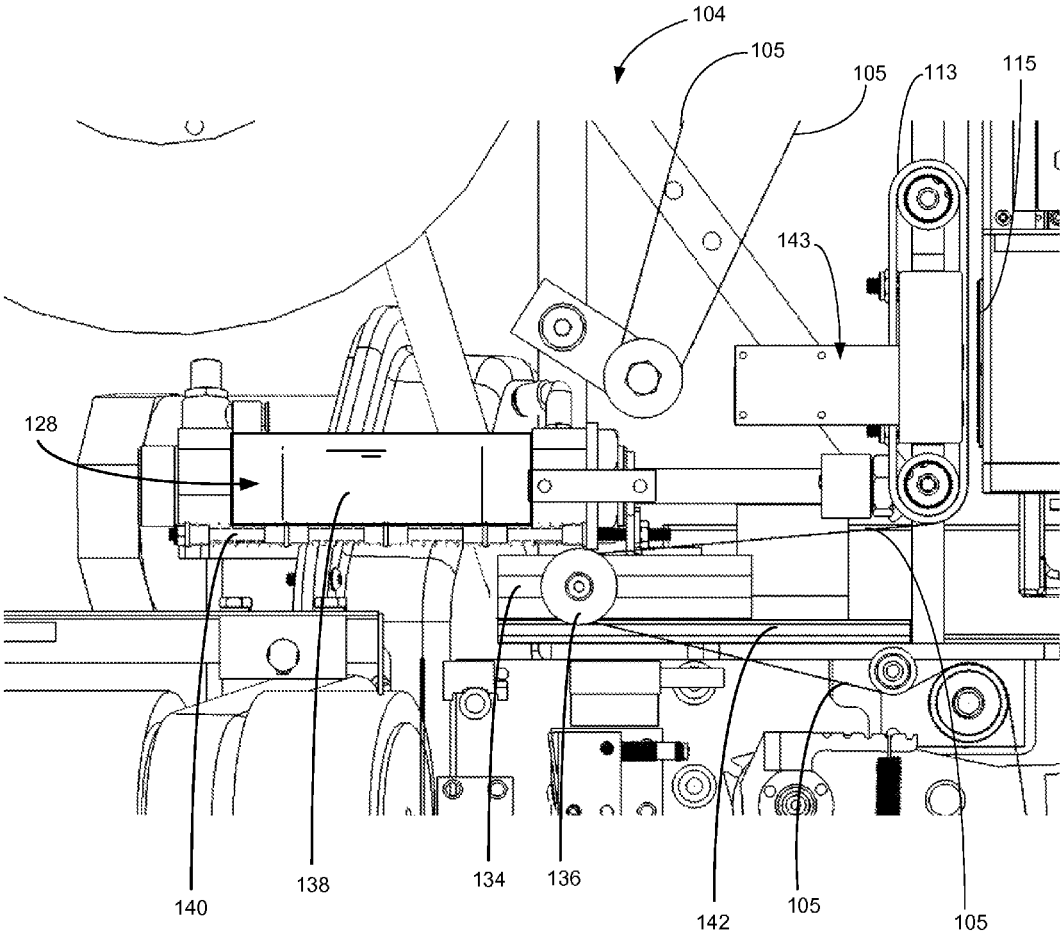
FIG. 5 is a close-up view of the shuttle indexer of the tape feed assembly.

Turning to FIGS. 4 and 5, shown therein is a front view and a close-up view of the tape feed assembly 104. The tape feed assembly 104 generally includes a shuttle indexer 128, a roll of tape 130 and a series of intervening pulleys that route the tape 105 through the tape closure device 100. For the tape closure device 100 to work properly, it is desirable that the tape feed assembly 104 provide tape 105 to the closure application assembly 108 under relatively low tension. The shuttle indexer 128 provides a defined quantity of slack in the tape 105 to allow the tape closure device 100 to function smoothly as the tape closure 126 is made. This is a significant improvement over prior art systems in which tape is pulled directly from a roll of tape during a closure cycle.

The shuttle indexer 128 includes a carriage block 134, an indexer pulley 136, a double acting pneumatic (or hydraulic) cylinder 138 and a spring 140. The carriage block 134 rides on a slide 142 in a reciprocating, substantially linear fashion. The indexer pulley 136 is mounted to the carriage block 134. Tape 105 is routed around the indexer pulley 136 into the closure application assembly 108 of the tape closure device 100. The carriage block 134 is connected to the pneumatic cylinder 138 with a one-way stop, such that the pneumatic cylinder 138 passes through the carriage block 134 without moving the carriage block 134 during extension, but the retraction of the pneumatic cylinder 138 causes the carriage block to move to a home position. In a presently preferred embodiment, the one-way stop of the pneumatic cylinder 138 includes a series of washers or nuts that are made to contact a flange on the carriage block 134 during the retraction of the pneumatic cylinder 138.

In preparation for a closure cycle, the pneumatic cylinder 138 is retracted to the home position. As the pneumatic cylinder 138 retracts, it forces the carriage block 134 to also return to the home position shown in FIG. 5. As the carriage block 134 is forced away from the closure application assembly 108, the indexer pulley 136 draws a length of tape 105 from the roll of tape 130.

At the beginning of the next closure cycle, the pneumatic cylinder 138 is reversed and rapidly extended, thereby freeing the carriage block 134 and indexer pulley 136 to move along the slide 142 (as shown in FIG. 5). As the closure application assembly 108 creates the tape closure 126, tape 105 is easily dispensed as the carriage block 134 and indexer pulley 136 move along the slide 142 to accommodate the downstream consumption of tape 105. The spring 140 provides a light resistance to the movement of the carriage block 134 to prevent a jerky, uncontrolled acceleration of the carriage block 134.

In this way, the shuttle indexer 128 draws a selected length of tape 105 from the roll of tape 130 and then makes the tape 105 available under controlled, reduced tension during the subsequent closure cycle. The shuttle indexer 128 is preferably configured to prepare an excess amount of tape 105 before each closure cycle. Since the movement of the carriage block 134 and indexer pulley 136 during a closure cycle is controlled by the amount of tape 105 actually consumed during the cycle, the return of the carriage block 134 and indexer pulley 136 only pulls from the roll of tape 130 as much tape 105 as was consumed during the previous cycle. In this way, the shuttle indexer 128 supplies the closure application assembly 108 with the necessary amount of tape 105 with limited resistance without accumulating excess tape 105 between cycles.

Figure 6:
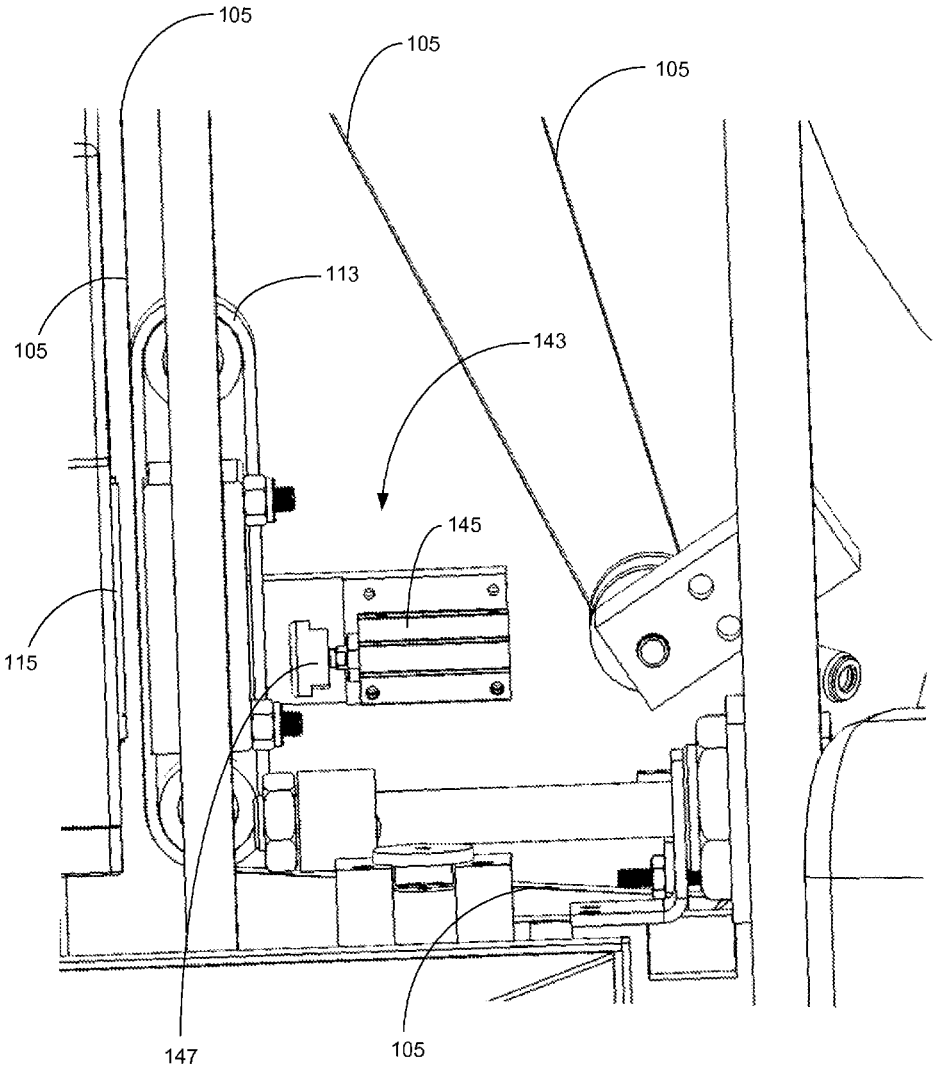
FIG. 6 is a close-up view of the belt clamp assembly of the tape feed assembly.

To further isolate the closure application assembly 108 from the roll of tape 130, the tape closure device 100 further includes a belt clamp assembly 143, shown in FIG. 6. FIG. 6 provides a rear, close-up view of the tape closure device 100 that illustrates the form and function of the belt clamp assembly 143. The belt clamp assembly 143 prevents the print belt 113 from rotating during a closure cycle. Since the tape 105 is adhered to the print belt 113, if the print belt 113 was not locked during a closure cycle, the travel distance of the carriage block 134 could potentially vary substantially from closure to closure because part of the needed tape 105 could be pulled directly from the tape roll 105. This variable travel distance of the carriage block 134 could in turn cause problems with the encoder readings and tape tracking. Therefore, it is preferred that the print belt 113 be clamped in a stationary position during the closure cycle to ensure that the carriage block 134 moves the same distance during each closure cycle.

The belt clamp assembly 143 includes a small pneumatic cylinder 145 and a press 147. The small cylinder 145 is preferably plumbed in parallel with the larger pneumatic cylinder 138. Therefore, the large and small pneumatic cylinders 138, 145 extend at substantially the same time, and they retract at substantially the same time. Since the small pneumatic cylinder 145 is smaller than the large cylinder 138, the small pneumatic cylinder 145 actuates slightly faster than the large cylinder 138. At the beginning of a closure cycle, the rod of the pneumatic cylinder 138 extends so that the carriage block 134 is free to slide. At the same time, the piston of the small air cylinder 145 extends and pushes the press 147 against the print belt 113 to prevent the print belt 113 from rotating. Since the adhesive side of the tape 105 is stuck to the print belt 113, the tape 105 above the print belt 113 does not move while the closure is being formed. At the end of the closure cycle, the small cylinder 145 retracts, thereby freeing the print belt 113 to allow additional tape 105 to be drawn into the closure application assembly 108.

Thus, once the appropriate length of tape 105 has been drawn by the shuttle indexer 128 in preparation for a closure cycle, the roll of tape 130 remains stationary during the closure cycle. In this way, the belt clamp assembly 143 isolates the roll of tape 130 from the closure application assembly 108 during the closure cycle and the closure application assembly 108 is not required to rotate the significant mass within the roll of tape 130 during the closure cycle.

Figure 7:
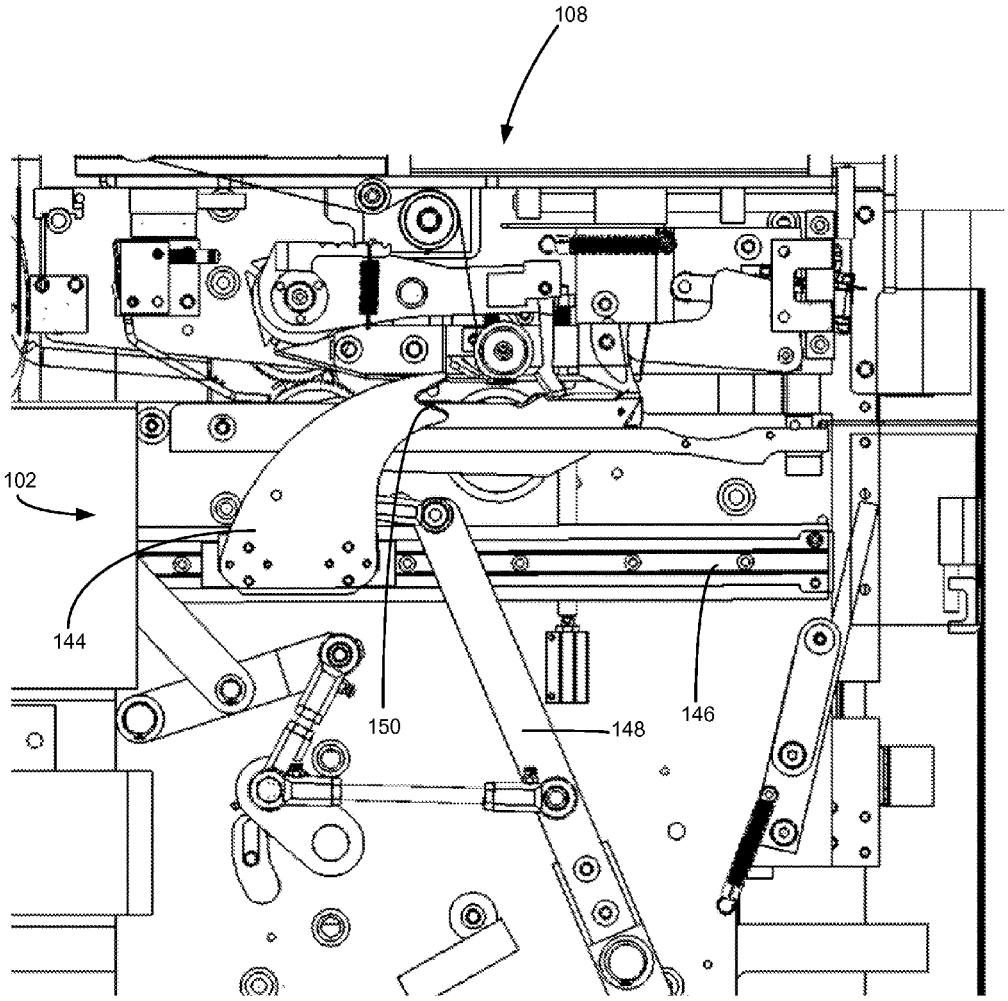
FIG. 7 is a close-up view of the plunger assembly.

Turning to FIG. 7, the plunger assembly 102 preferably includes a pair of plungers 144, a track 146 and a series of linkages 148. Each plunger 144 preferably includes a notched portion 150 configured to securely grasp the neck 124 of the bag 120 as it moves through the closure application assembly 108. During each cycle of the tape closure device 100, the plungers 144 are moved from the upstream end of the track 146 to the downstream end of the track 146 and back to the upstream end of the track 146.

Figure 8:
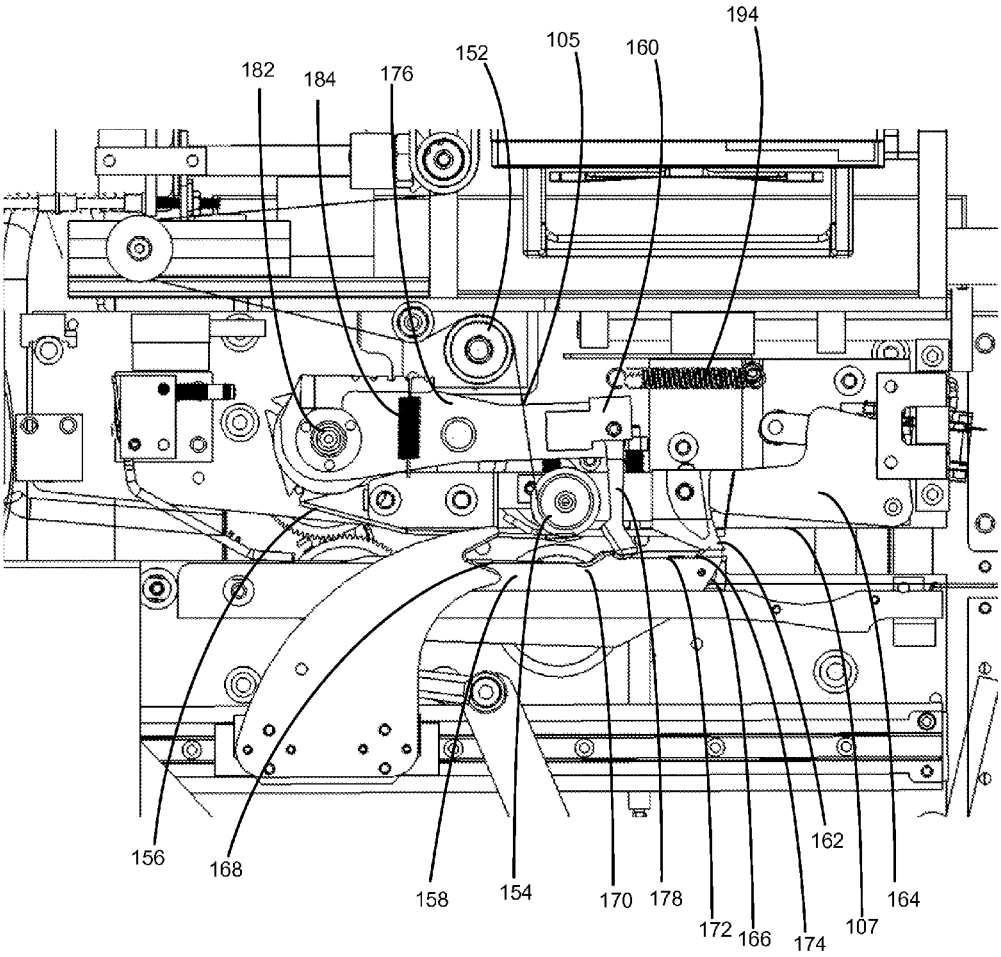
FIG. 8 is a front view of the closure application assembly.

Turning to FIG. 8, shown therein is a close-up view of the closure application assembly 108. The closure application assembly 108 preferably includes an encoder wheel 152, tape guide pulley 154, an upper guide rail 156, a lower guide rail 158, a bag stop 160, contact member 162, a cutting member 164, and a paper feed pulley 166. The lower guide rail 158 preferably includes a staging section 168, a gathering section 170 and a contact section 172. Paper 107 is fed from the right side of the closure application assembly 108 around the paper feed pulley 166 and through a slot 174 in the contact section 172. Tape 105 is fed from the left side of the closure application assembly 108 around the encoder wheel 152 and tape guide pulley 154 towards the gathering section 170. The tape 105 is preferably fed such that the adhesive side of the tape 105 is oriented towards the lower guide rail 158. At the beginning of each cycle, tape is secured between the bag stop 160 and the gathering section 170 and extends along the contact section 172 under the contact member 162, with a leading portion of the tape 105 secured to a leading portion of backing paper that extends through the slot 174.

In the preferred embodiment, the contact section 172 of the lower guide rail 158 is slightly higher than the staging section 168. The gathering section 170 includes a ramped portion that rises from the staging section 168 to the contact section 172. In a particularly preferred embodiment, the gathering section 170 rises to an elevation that is slightly higher than the contact section 172 and includes a small ramp down to the contact section 172. The contour of the lower guide rail 158 encourages a tight gathering of the neck of the bag 120.

The upper guide rail 156 extends along at a spaced-apart distance from the lower guide rail 158. The upper guide rail 156 includes a wider opening from the lower guide rail 158 that narrows as the upper and lower guide rails 156, 158 approach the tape guide pulley 154. In this way, the neck of the bag 120 is increasingly gathered as it proceeds between the upper and lower guide rails 156, 158 toward the gathering section 170. In a highly preferred embodiment, the upper guide rail 156 terminates at a point below the tape guide pulley 154.

The closure application assembly 108 provides a non-stop, linear mechanism that provides a tight tape closure 126 as bags 120 pass through the tape closure device 100. The linear, constant movement of the bag 120 through the closure application assembly 108 enables the tape closure device 100 to be used for high-speed, high-volume operation.

Figure 9:
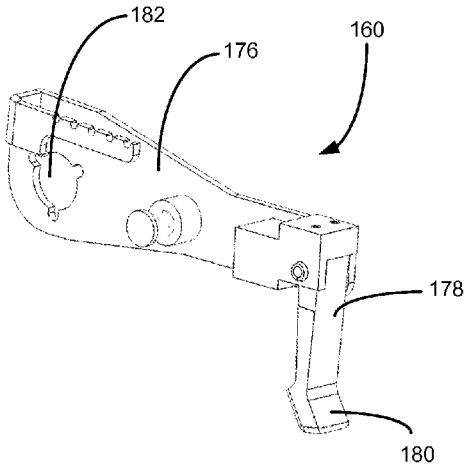
FIG. 9 is a perspective view of the bag stop.

Continuing with FIG. 8 and also referring to FIG. 9, in a presently preferred embodiment, the bag stop 160 includes a pivot arm 176, a leg member 178 and a foot piece 180. The pivot arm 176 preferably pivots about a first pivot point 182 and the rotational movement of the pivot arm 176 is resisted by a pivot arm spring 184 (not shown in FIG. 9). The leg member 178 is preferably configured as a downward extending member that is rigidly fixed to the pivot arm 176. The foot piece 180 is secured to the distal end of the leg member 178 and makes contact with the tape 105. In a preferred embodiment, the foot piece 180 includes a roller configured to rotate as the tape 105 passes under the leg member 178. Alternatively, the foot piece 180 may include a solid bumper that presses down on the non-adhesive side of the tape 105. The pivot arm 176 and leg member 178 are configured such that the foot piece 180 rests on the ramp between the gathering section 170 and the contact section 172.

Figure 10:
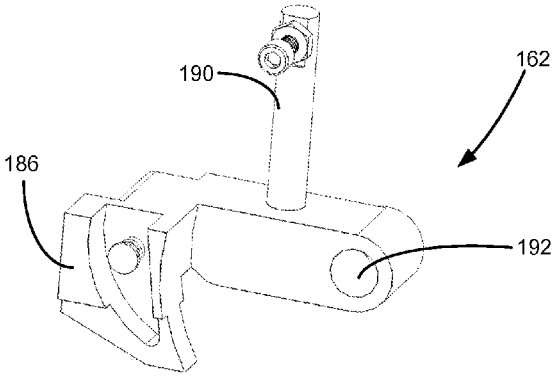
FIG. 10 is a perspective view of the contact member.

Continuing with FIG. 8 and also referring to FIG. 10, the contact member 162 preferably includes an angled headpiece 186 and a spring post 190. The headpiece 186 is configured to rotate with respect to a second pivot point pin 192, which rotates about a pivot post 193 (shown in FIG. 11). The angular configuration of the headpiece 186 causes the movement of a bag 120 into the headpiece 186 to lift the headpiece 186. The upward movement of the headpiece 186 is resisted by a contact member spring 194 (not shown in FIG. 10) that is attached to the spring post 190. The contact member spring 194 urges the contact member 162 to rotate downward where the headpiece 186 is in contact with the contact section 172.

Figure 11:
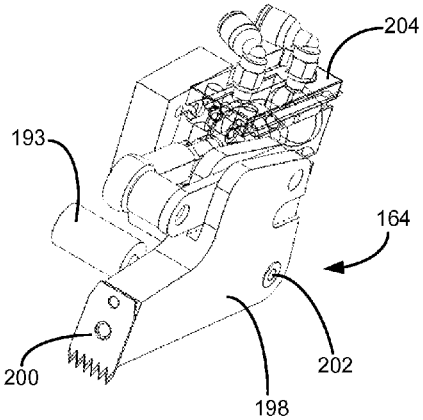
FIG. 11 is a perspective view of the cutting member.

Continuing with FIG. 8 but also now referring to FIG. 11, the cutting member 164 includes a cutting head 198 and a knife 200. The cutting head 198 is configured for rotation about a third pivot point 202. The cutting member 164 preferably includes a two-way pneumatic cylinder 204 that causes the cutting head 198 to rotate back and forth as pressure is applied to either side of the two-way pneumatic cylinder 204. Although a pneumatic cylinder 204 is presently preferred, it will be appreciated that other motors could be used to controllably actuate the cutting member 164.

Unlike prior art designs, the operation of the cutting member 164 is controlled electronically and automatically by the control system 116 in response to a signal originating from the encoder wheel 152. After a pre-selected length of tape 105 has passed over the encoder wheel 152 and a pre-selected delay has passed, the control system 116 activates the cutting member 164 to sever the trailing end of the tape 105 from the tape closure 126, thereby forming the second leg 208 of the tape closure 126. In this way, the length of a first leg 206 of the tape closure 126 is approximately determined as a result of the relative distances between the leading edge of the tape 105 extending beyond the contact portion 172 and the paper slot 174. The length of the second leg 208 of the tape closure 126, however, is largely determined by the operational scheduling imposed by the control system 116.

The encoder wheel 152 is equipped with a rotary digital encoder (not separately shown in the drawings) that outputs a signal representative of the number of rotations made by the encoder wheel 152 during operation. As tape passes over and rotates the encoder wheel 152, the encoder wheel sends a signal to the control system 116 that reflects the amount of tape that has passed into the closure application assembly 108. Thus, during each closure cycle, tape is pulled into the closure application assembly 108 and the encoder wheel 152 measures the amount of tape fed into the closure application assembly 108. In the presently preferred embodiment, the control system 116 is configured to adjust the amount of tape used during each closure cycle by attempting to achieve a predetermined tape length set point established by the user. The amount of tape consumed during a closure cycle is controlled by the timing of the activation of the cutting member 164.

Thus, in a preferred embodiment, the control system 116 begins each closure cycle by retrieving a selected amount of tape through the shuttle indexer 128. Next, the plungers 102 are activated to catch the bag 120 as it is conveyed into the closure application assembly 108. Once the neck of the bag 120 reaches the bag stop 160 and tape, it begins to form the tape loop 210 around the neck of the bag 120 and the first leg 206 is formed by the tape 105 already present on the contact section 172. As the bag 120 continues to move through the closure application assembly 108, tape continues to pass over the encoder wheel 152. The second leg 208 is formed by selectively severing the trailing end of the tape 105 as the bag 120 moves beyond the closure application assembly 108.

In a highly preferred embodiment, the control system 116 includes one or more algorithms, routines or programs that are configured to adaptively correct the operation of the closure application assembly 108 on a dynamic basis. At the beginning of the adaptive correction routine, the tape length set point is established for each tape closure 126. The set point is loaded into the control system 116 by the user. For example, a preferred tape length set point could be 4 inches (4"). In the presently preferred embodiment, the tape length set point represents the amount of tape consumed during a single tape closure cycle.

During the tape closure cycle, the encoder wheel 152 continuously feeds a length measurement into the control system 116. Due to delays caused by signal processing and transmission and activation and movement of the cutting member 164, the control system 116 must instruct the cutting member 164 to activate at a point before the prescribed tape length set point has passed over the encoder wheel 152 by a delay factor. The encoder wheel 152 continues to send information to the control system 116 after the cutting member 164 has been activated by the control system 116. Once the cutting member 164 completes the cutting operation, a closure cycle termination signal is sent from the cutting member 164 to the control system 116. The closure cycle termination signal is preferably generated by a sensor located within the cutting member 164 or at the source of the pneumatic pressure that governs the movement of the cutting member 164.

Due to variations in system speed, bag thickness, the extent to which the neck of the bag was gathered and other environmental factors, there may be some variation in the amount of tape dispensed during a closure cycle. Once the control system 116 receives the closure cycle termination signal, the control system automatically compares the length of tape that passed over the encoder wheel 152 against the tape length set point. If the amount of tape 105 consumed during the closure cycle is different from the tape length set point to an extent that exceeds a preset allowable variance, the control system 116 automatically adjusts the timing of the activation of the cutting member 164 to reduce the variance between the length of tape 105 consumed and the tape length set point. For example, if too much tape 105 was dispensed into the closure application assembly 108 during a closure cycle, the control system 116 will reduce the delay factor and activate the cutting member 164 earlier in the closure cycle. Conversely, if the too little tape 105 is being dispensed during a closure cycle, the control system 116 will increase the delay factor to allow additional tape 105 to pass into the closure application assembly 108 before the cutting member 164 completes the cutting operation. In a particularly preferred embodiment, the control system 116 will make adjustments to the point at which the cutting member 164 is activated by measuring the variance in the measured tape length from the tape length set point, dividing the variance by a correction factor, and applying the quotient as an adjusted delay factor in the subsequent tape closure cycle. The response of the control system 116 can be made more or less aggressive by increasing or decreasing the correction factor. To account for isolated disturbances in the system, the control system 116 can also be made to operate on an averaged basis over a series of closure cycles. For example, the control system 116 can be configured to average the variance between the measured tape length and the tape length set point over a series of ten closure cycles.

The ability to dynamically control the length of the second leg 208 of the tape closure 126 is of significant value. By precisely controlling the length of the tape closure 126 legs, the control system 116 can ensure that the indicia placed on the tape 105 by the printer assembly 112 is consistently located in a desired location on the tape legs 206, 208. Prior art systems that are unable to dynamically adjust to control the length of the tape legs in response to environmental variables are prone to making the tape closure 126 in a manner in which the indicia is positioned at different and undesirable locations. Furthermore, the tape closure 126 device 100 can be more easily configured to apply closures to different products while ensuring a consistent and desirable tape closure 126.

It is to be understood that even though numerous characteristics and advantages of various embodiments of the present invention have been set forth in the foregoing description, together with details of the structure and functions of various embodiments of the invention, this disclosure is illustrative only, and changes may be made in detail, especially in matters of structure and arrangement of parts within the principles of the present invention to the full extent indicated by the broad general meaning of the terms expressed herein. It will be appreciated by those skilled in the art that the teachings of the present invention can be applied to other systems without departing from the scope and spirit of the present invention as set forth in the appended claims.

It is claimed:

1. A tape closure device for securing a neck of a bag with a tape closure during a closure cycle, wherein the tape closure has a first leg and a second leg, and the tape closure device comprising:

an automated control system;

a tape feed assembly configured to provide a continuous length of tape; wherein the tape feed assembly further includes a belt clamp assembly comprising:

a small pneumatic cylinder;

a press;

a closure application assembly configured to pull the continuous length of tape from the tape feed assembly and form the tape closure around the neck of the bag during the closure cycle, wherein the closure application assembly includes an encoder wheel that outputs to the automated control system a signal representative of the length of tape provided to the closure application assembly from the tape feed assembly during the closure cycle;

a motorized cutting member configured to sever the continuous length of tape from the tape closure around the neck of the bag, wherein the motorized cutting member is connected to the automated control system and configured for selective activation by the automated control system in response to the signal provided by the encoder wheel to control the length of the second leg of the tape closure; and wherein the belt clamp assembly is configured to selectively isolate the closure application assembly from the tape feed assembly during a closure cycle.

2. The tape closure device of claim 1, wherein the closure application assembly further comprises:

an upper guide rail; and a lower guide rail.

3. The tape closure device of claim 1, wherein the closure application assembly further comprises a pivotally movable bag stop, wherein the bag stop comprises:

a pivot arm;

a leg member; and a foot piece.

4. The tape closure device of claim 3, wherein the closure application assembly further comprises a pivotally movable contact member that is not connected to the bag stop, wherein the pivotally movable contact member comprises:

a swing arm;

a headpiece connected to the swing arm;

a spring post connected to the swing arm; and a contact member spring connected to the spring post, wherein the contact member spring opposes the pivotal movement of the contact member.

5. The tape closure device of claim 1, wherein the tape closure device further comprises a paper feed assembly, wherein the paper feed assembly is configured to provide a continuous length of paper to the closure application assembly.

6. The tape closure device of claim 1, wherein the tape feed assembly further comprises a shuttle indexer connected to the control system, wherein the shuttle indexer is configured to linearly reciprocate and wherein the shuttle indexer includes:

a slide;

a carriage block mounted for reciprocating linear movement on the slide; and an indexer pulley mounted on the carriage block.

7. The tape closure device of claim 6, wherein the shuttle indexer further comprises a pneumatic cylinder that is operably connected to the carriage block and controllably operated by the control system.

8. The tape closure device of claim 7, wherein the pneumatic cylinder is configured to permit the linear movement of the carriage block when the pneumatic cylinder is deployed.

9. A tape closure device for securing a neck of a bag with a tape closure during a closure cycle, the tape closure device comprising:

an automated control system;

a tape feed assembly configured to provide a continuous length of tape; wherein the tape feed assembly further comprises a shuttle indexer connected to the automated control system, wherein the shuttle indexer is configured to linearly reciprocate and wherein the shuttle indexer includes:

a slide;

a carriage block mounted for reciprocating linear movement on the slide; and an indexer pulley mounted on the carriage block;

a print belt, wherein the continuous length of tape is temporarily adhered to the print belt before it reaches the shuttle indexer;

a belt clamp assembly configured to selectively lock the print belt in place during the closure cycle; and a closure application assembly.

10. The tape closure device of claim 9, wherein the shuttle indexer further comprises a pneumatic cylinder that is operably connected to the carriage block and controllably operated by the control system.

11. The tape closure device of claim 10, wherein the pneumatic cylinder is configured to permit the linear movement of the carriage block when the pneumatic cylinder is deployed.

12. The tape closure device of claim 9, wherein the closure application assembly is configured to pull the continuous length of tape from the tape feed assembly and form the tape closure around the neck of the bag during the closure cycle, and wherein the closure application assembly includes an encoder wheel that outputs to the automated control system a signal representative of the length of tape provided to the closure application assembly from the tape feed assembly during the closure cycle.

13. The tape closure device of claim 12, further comprising:

a motorized cutting member, wherein the motorized cutting member is connected to the automated control system and configured for selective activation by the automated control system in response to the signal provided by the encoder wheel.

14. A method for applying a tape closure to a neck of a bag, wherein the tape closure has a first leg and a second leg, the method comprising the steps of:

providing a continuous length of tape from a roll of tape, onto a print belt, to a guide rail of a closure application assembly;

providing a continuous length of paper from a roll of paper to the guide rail of the closure application assembly;

passing the neck of the bag through the closure application assembly to draw into the closure application assembly a length of tape from the roll of tape;

isolating the length of tape in the closure application assembly from the roll of tape by locking the print belt with a belt clamp assembly;

measuring with the length of the tape drawn into the closure application assembly as the neck of the bag is passed through the closure application assembly;

encoding the measured length of the tape drawn into the closure application assembly into a tape closure length signal;

processing the tape closure length signal; and activating a motorized cutting mechanism to sever the continuous length of tape and the continuous length of paper in response to the tape closure length signal to control the length of the second leg of the tape closure.

15. The method of claim 14, wherein the step of processing the tape closure length signal further comprises:

establishing a predetermined a tape length set point;

comparing the measured length of tape drawn into the closure application assembly against the predetermined tape length set point;

creating a tape length correction factor; and adjusting the activation of the motorized cutting mechanism in a subsequent tape closure cycle in response to the tape length correction factor.

16. The method of claim 14, wherein the method further comprises the step of retracting a shuttle indexer to draw a predetermined length of tape from the roll of tape before the step of passing the neck of the bag through the closure application assembly.

17. The method of claim 16, wherein the method further comprises the step of releasing the shuttle indexer to permit the movement of the shuttle indexer as tape is drawn into the closure application assembly.

18. The method of claim 17, wherein the step of releasing the shuttle indexer further comprises deploying a pneumatic cylinder that permits the linear movement of the shuttle indexer toward the closure application assembly.

19. The method of claim 18, wherein the step of retracting the shuttle indexer comprises retracting the pneumatic cylinder to force the shuttle indexer to draw a length of tape from the roll of tape as the shuttle indexer returns to the retracted position.

* * * * *